United States Patent [19]

Stafford

[11] Patent Number: 4,516,661

[45] Date of Patent: May 14, 1985

[54] SAFETY DEVICE FOR SCAFFOLD

[76] Inventor: Lawrence R. Stafford, 8 Gracemore St., Albany, N.Y. 12203

[21] Appl. No.: 529,010

[22] Filed: Sep. 2, 1983

Related U.S. Application Data

[63] Continuation-in-part of Ser. No. 415,756, Sep. 7, 1982.

[51] Int. Cl.[3] ..... E04G 5/04

[52] U.S. Cl. ..... 182/82; 182/229

[58] Field of Search ..... 182/229, 82, 142, 143, 182/19

[56] References Cited

U.S. PATENT DOCUMENTS

| | | | |
|---|---|---|---|
| 12,145 | 8/1903 | Whitner | 182/4 |
| 613,971 | 11/1898 | Cody | 182/82 |
| 770,685 | 9/1904 | Haas | 182/229 |
| 1,890,029 | 12/1932 | Delfs | 182/87 |
| 2,228,042 | 1/1941 | Zanger | 182/230 |
| 3,119,590 | 1/1964 | Ericksson | 182/82 |
| 3,347,339 | 10/1967 | Coole | 182/36 |

FOREIGN PATENT DOCUMENTS

| | | | |
|---|---|---|---|
| 58042 | 8/1982 | European Pat. Off. | 182/87 |
| 207052 | 12/1939 | Switzerland | 182/87 |

*Primary Examiner*—Reinaldo P. Machado
*Attorney, Agent, or Firm*—Handal & Morofsky

[57] ABSTRACT

A safety device for securing a scaffold to the side of a building in order to prevent movement thereof is disclosed. Such securing of the scaffold is achieved by placing a lanyard, preferably an adjustable lanyard, around the rope supporting the scaffold and securing the lanyard to a stud on the side of a building through the use of a yoke.

7 Claims, 13 Drawing Figures

SAFETY DEVICE FOR SCAFFOLD

CROSS REFERENCE

This application is a continuation in part of U.S. Ser. No. 415,756 of Stafford filed Sept. 7, 1982, the disclosure of which is incorporated herein by reference.

TECHNICAL FIELD

The invention relates to a safety device for securing a scaffold to the side of a building in order to prevent movement thereof and the dangerous conditions attendant thereto.

BACKGROUND ART

Moveable scaffolds are used by workmen for many external maintenance tasks. These tasks may include repairs to the outside surface of the building, modifications of the same, window washing, painting and the like. Such devices are well known and take a wide variety of forms. Likewise, for many years, the hazards associated with such moveable scaffolds are also well known. These hazards include, by way of example, displacement of the scaffold due to movement of workers on the scaffold or due to wind or other environmental factors. At least as early as the beginning of this century, various means have been proposed for improving the stability of scaffolds. For example, in U.S. Pat. No. 770,685, use of a bracket to attach a scaffold to a building is suggested. Likewise, U.S. Pat. No. 3,347,339 of Coole and U.S. Pat. No. 2,228,042 of Zanger, suggest other stabilizing arrangements.

In spite of the plethora of safety devices for increasing the stability of moveable scaffolds, such safety systems have not seen widespread employment because of fundamental problems from which they suffer. In particular, in order for a scaffold stabilizing device to be acceptable, it must be convenient to attach and detach; it must be dependable; and, finally, it must be of such a nature that the worker on a scaffold will actually use it. In addition, cost considerations dictate that any device used be economical and require a minimum of maintenance.

Most recently, newly constructed buildings are being equipped with tracks which are integral with the side of the external building wall. These new systems have experienced great success and this has pointed out the real importance of finding an acceptable system which may be retrofitted into existing structures. Indeed, the dependability of such systems and the ease with which they may be used has been dramatically illustrated by the feats of a number of "daredevils" who have utilized these systems to climb the sides of some of the world's tallest buildings. Nevertheless, while these most modern systems may, in theory, be retrofitted to existing structures, the costs involved with such retrofittings are so high as to remove this from the range of desirable alternatives.

DISCLOSURE OF INVENTION

The invention, as claimed, is intended to provide a remedy. It solves the problem of providing an easily retrofittable system for the outside of a building to stabilize scaffolding. The same is achieved by providing the building with a system of anchors which are easily mounted in a wide variety of building surfaces and by providing the scaffolds with a spring loaded yoke which mates with and attaches to the anchors.

BRIEF DESCRIPTION OF DRAWINGS

One way of carrying out the invention is described in detail below with reference to the drawings which illustrate only specific embodiments, in which.

BEST MODE FOR CARRYING OUT THE INVENTION

Figure 1:
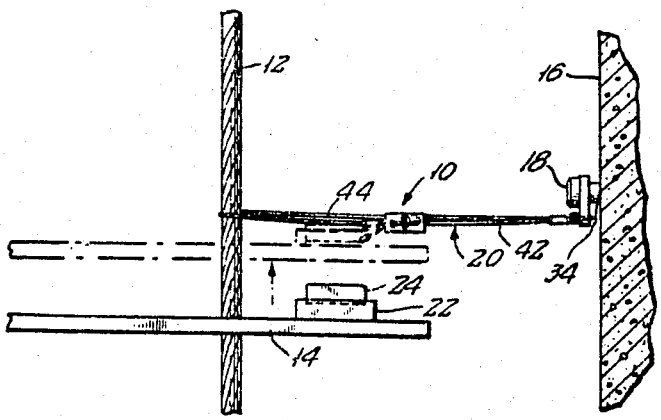
FIG. 1 is a plan view of the inventive system.

Turning first to FIG. 1, the inventive system 10 for securing a cable 12 bearing a scaffold 14 from swaying to far from the wall of a building 16, is illustrated. In general, the inventive system 10 works by securing cable 12 to an anchor 18 on the side of building 16 by an adjustable lanyard assembly 20. Generally, undesirable movement of the scaffold 14 is prevented by limiting the movement of support cable 12. In accordance with the preferred embodiment of the invention, it is contemplated that anchors 18 are installed on the side of the building at spaced intervals at points which correspond to the path which the support cable 12 follows during use of the scaffold. Generally, it is contemplated that anchors 18 are to be installed in pairs corresponding to the two support cables 12 which support the scaffold at vertical distances corresponding to a separation of three stories on, approximately, every forty feet.

Generally, the system 10 illustrated in FIG. 1, works by limiting the extent to which support cable 12 is free to sway as a result of wind or other environmental factors, from the rest position with respect to the top of the building 16. Inasmuch as the system is secured to the anchor manually, it is possible for a worker inadvertantly to try to raise the platform 14 while the system 10 is still in place. As a possible added safety feature, the invention contemplates the use of an electrical switch 22 which, when the platform is raised to the position illustrated in phantom lines in FIG. 1, will result in depression of the actuator 24 of the switch and, accordingly, a change in the electrical state of the switch. This change of state may be detected by a suitable control apparatus and used to disable the electrical or other mechanical means being used to raise and lower the scaffold 14. Switch 22 may be any of a number of possible well known systems which include large actuators 24 which may be easily and reliably engaged with the lanyard assembly 20 due to the large surface area of the actuator 24 and the sensitivity of the electrical switch.

Figure 2:
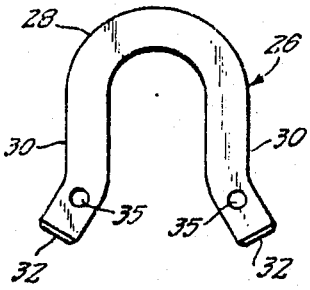
FIG. 2 is a plan view of the yoke of the inventive system.

As shown most clearly in FIG. 2, the system 10 comprises a yoke 26 which includes a rounded portion 28, a pair of straight portions 30 and a pair of ear portions 32. The inner diameter of rounded portion 28 has a radius substantially equal to the radius of the support post portion 34 (FIG. 3) of anchors 18. Yoke 26 also includes a pair of holes 35 in the ear portion of the yoke.

Figure 3:
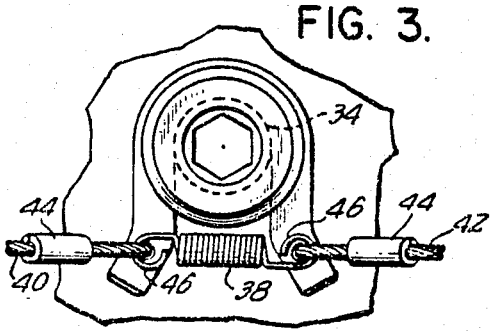
FIG. 3 is a plan view of the yoke and its associated parts in engagement with an anchor mounted on the side of the building.
Figure 4:
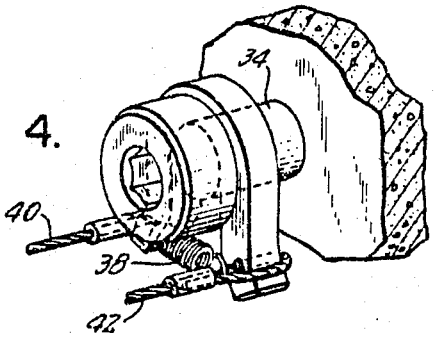
FIG. 4 is a perspective view of the yoke and anchor portion of the inventive system during use.
Figure 5:
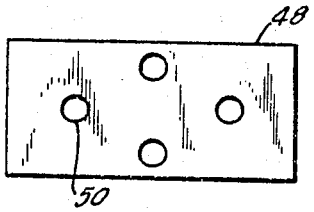
FIG. 5 is a plan view of a cable lock used in the system of the present invention.

As shown in FIGS. 3 and 4, yoke 26 when it is secured to an anchor 16 is disposed around the support post portion 34 of the anchor 18. It is retained in position by a spring 38. The main support function is provided by a fixed lanyard 40 and an adjustable lanyard 42. Lanyards 40 and 42 are secured to yoke 26 by being passed through holes 35 and having their ends closed into loops under compression fittings 44. Spring 38, in turn, is secured to the assembly by having its ends 46 secured around the loops formed at the ends of lanyards 40 and 42. The adjustable lanyard and the fixed lanyard are secured together by a cable lock 48 which includes a plurality of holes 50 (FIG. 5).

Figure 6:
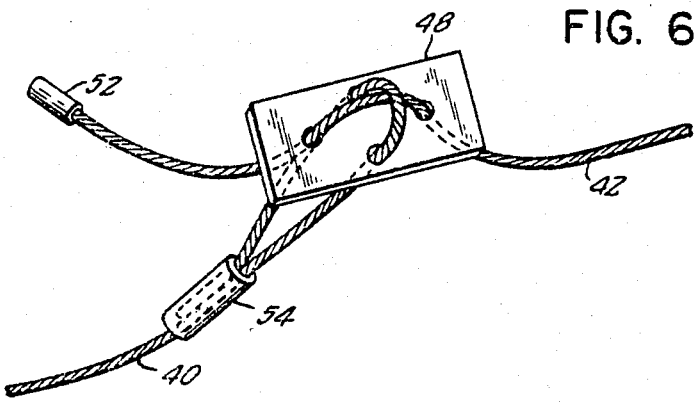
FIG. 6 is a perspective view of the cable lock showing its operation.

As shown in FIG. 6, two of the holes receive the end of the adjustable cable opposite that end of the adjustable cable 42 which is secured to the yoke. The very end of this end of the adjustable cable 42 is, in turn, provided with a compression fitting 52 which prevents the cable of a lanyard from unwinding and, in the event of extreme stresses and sliding prevents the adjustable cable from becoming disgaged from the cable lock. The end of the fixed cable 40 opposite that end which is secured to yoke 26 is formed into a loop which passes through two of the holes of the cable lock, as illustrated in FIG. 6. This loop is, in turn, closed by compression fitting 54.

Figure 7:
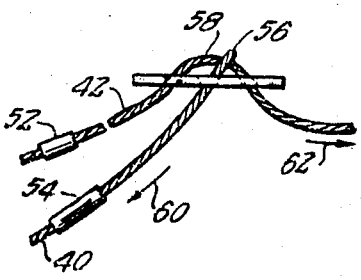
FIG. 7 is a side plan view showing the operation of the cable lock of FIGS. 5 and 6.

As illustrated in FIG. 7, this particular arrangement of a cable lock is particularly advantageous inasmuch as the relatively adjustable free end of adjustable cable 42 is, during use, compressed against the cable lock 48 by the loop 56 formed at the end of cable 40. In particular, the underside of loop 56 bears against the top 58 of that portion of cable 42 which passes through cable lock 48 when forces in the direction of arrows 60 and 62 are applied to the lanyard. It is noted that during use, in the event that the cable begins to sway, such forces will be applied to the lanyards.

Figure 8:
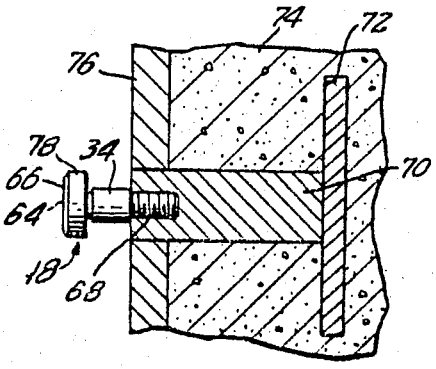
FIG. 8 is a cross-sectional view showing one system for the mounting of an anchor in a building element.

As illustrated in FIG. 8, the anchor 18 used in accordance with the present invention, comprises a flat portion 64 and a bevelled front edge 66. The end of the anchor which is to be secured to the building is provided with threads 68 which, in turn, mate with a tapped hole in a metal receiving member 70 which, in turn is secured to a bar 72, which is securely lodged within the core 74 of a precast masonry element 76. Of course, other anchoring means may be used to provide a tapped hole in a building element. For example in the event that the anchor 26 is to be secured to a metal element having a relatively thin wall, e.g., an extrusion, one may use a fastener of the type marketed by the B. F. Goodrich Co., under the trademark "Rivnut". Alternatively, if a relatively thickly walled concrete element is encountered in a retrofitting application, one may use a device such as the anchoring device marketed by ITT Phillips Drill Divison under the trademark "Redhead" and bearing catalog number RM-38.

While the invention is capable of employment using a wide range of material and dimensions, in a system in which the diameter of rounded portion 28 was one-half of one inch, and the yoke 26 had the shape illustrated in FIG. 2, particular success has been achieved by making the yoke of cold drawn 18-8 stainless steel. Likewise, anchors 26 are most easily provided by using standard socket shoulder screws having substantially the configuration illustrated in FIG. 8 and made of stainless steel. Lanyards were made using 1/16 inch 7×7 flexible galvanized aircraft cable. Likewise, springs made of stainless steel having a free length of 28.5 mm. and rated at 0.267 kg/mm were found to give suitable results. While not every aspect of the configuration of the yoke is critical, it was found that ear portions 32 must be of minimum length in order to prevent the loops at the ends of the lanyards from becoming entangled. In particular, the length shown in FIG. 2 was found to yield acceptable results.

When it is desired to use the system of the present invention, a plurality of devices 10 according to the system of the present invention are secured around the support cables 12 which support the scaffold 14. As the scaffold is lowered past the first set of anchors 26, the workman on the scaffold attaches the yoke to the anchor by first placing the inside of the yoke 26 over the head 78 of the anchor. The yoke is then pushed downwardly while at the same time being advanced toward the building, thus stretching the spring. Once this action has progressed to a limited extent, the anchor will be brought into snapping engagement with the yolk and the system properly secured. Removal is achieved by first placing the index finger of the left hand of the workman underneath the spring and advancing the spring over the face 64 of the anchor. The spring may be maintained in this position by using the middle finger of the left hand to retain it in this position The two index fingers of the workman are then used to urge the yoke upwardly. This action has the effect of disengaging the anchor.

Figure 9:
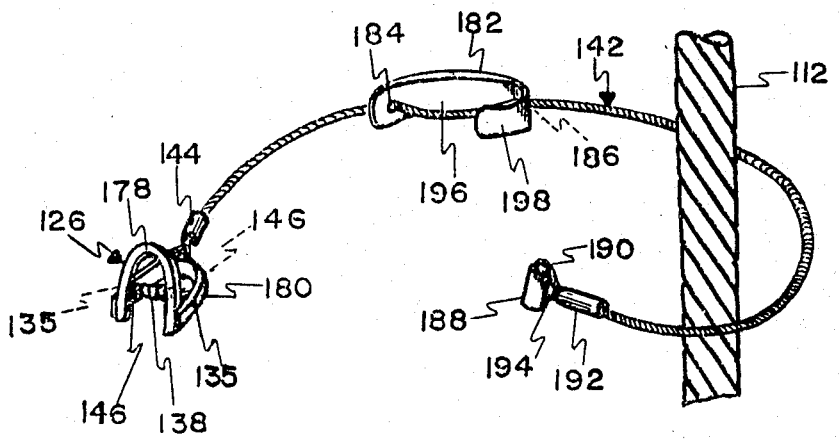
FIG. 9 is a perspective view of an alternate construction of the yoke and cable portion of the inventive system.

FIG. 9 shows an alternate construction of the yoke noted above, and of the cable elements of the inventive system. The foregoing discussion is incorporated by reference, and the corresponding elements on FIG. 9 are numbered 100 numerals higher for purposes of brevity and clarity. A yoke 126 comprises two U-shaped portions 178 and 180. A spring 138 is attached to portion 180 by placing two ends 146 of the spring through a pair of holes 135 in portion 180. Portion 178 is in a substantially perpendicular position with respect to portion 180 and is fixedly secured thereto. An adjustable lanyard 142 is secured to yoke 126 by looping the lanyard about portion 180 and securing it with a compression fitting 144. A securing plate 182 is disposed on lanyard 142 by a hole 184 and a hole 186 in plate 182. The diameters of holes 184 and 186 are larger than the diameter of cable 142 so that it may slide along it. Plate 182 is configured and dimensioned so that hole 184 and hole 186 in their respective positions are in a non colinear relationship. A lock cylinder 188 is also provided on lanyard 142. Lock cylinder 188 is secured to lanyard 142 by looping lanyard 142 through an axial hole 190 in cylinder 188 and securing the end to cable 142 by means of a compression fitting 192. A loop 194 is thus created.

The inventive system offers particular advantages when a yoke 126 and a lanyard system as illustrated in FIG. 9 are used. Spring 138 is securely held in position by the yoke portion 180 and is not attached to lanyards 42 and 40 as illustrated in the embodiment described earlier. This provides a more reliable system in that there is a reduced danger of unwanted interference between the spring and lanyards. Moreover, there need be only a single lanyard and the cost of materials is reduced. Because there is a single lanyard, the yoke 126 need not be flared (such as yoke 26 in FIG. 2) to prevent the lanyards from interfering with each other.

Figure 10:
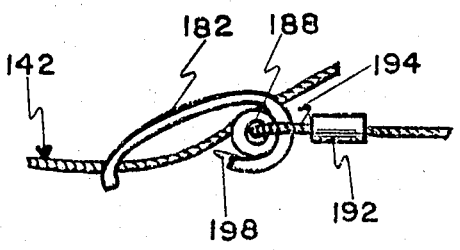
FIG. 10 is a top plan view showing the operation of the removeable cable lock of FIG. 9.

The system using the configuration of FIG. 9, eliminates the need for threading cable 112 through a fixed loop lanyard. Lanyard 142 is looped around cable 112, and cylinder 188 is placed in portion 198 of plate 182. (See FIG. 10.) An end 198 of plate 182 extends through loop 194 and thus secures cylinder 188 in position. Moreover, when tension is applied to cable 142, as shown in FIG. 10, the force exerted by cable 142 on cylinder 188 helps to retain the cylinder in curved portion 198. The lanyard is thus secured about cable 112. The system is adjustable since plate 182 may be moved axially along lanyard 142. When tension is applied to the system (as FIG. 1 shows), the plate will be held in a fixed position by virtue of the spring action of lanyard 142. This results from the fact that holes 184 and 186 are disposed about different axes.

Figure 11:
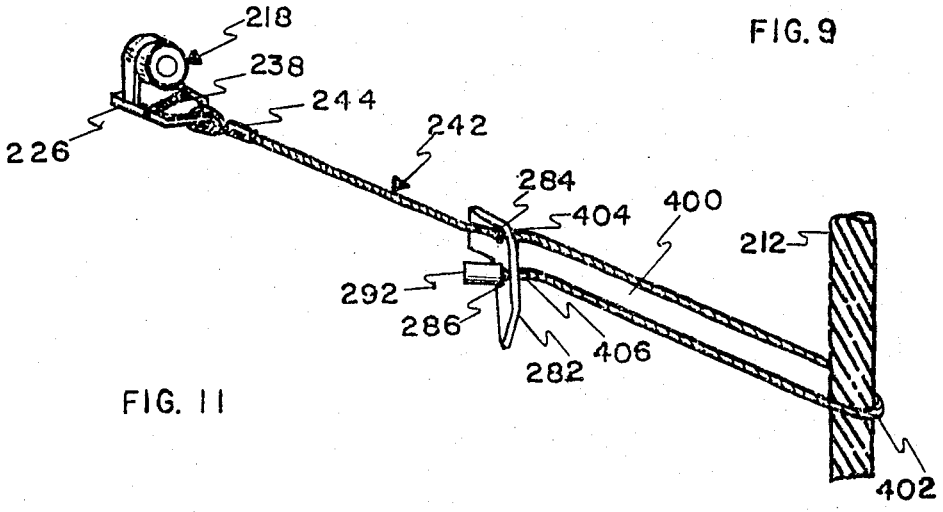
FIG. 11 is a perspective view of yet another construction of the cable portion of the inventive system.

FIG. 11 shows yet another configuration of the inventive system. For purposes of brevity and clarity the elements are numbered 200 numerals higher than the corresponding elements in the first embodiment shown in FIGS. 1 through 8. The discussion therein is included herein by reference. A yoke 226 fits over an anchor 218 in order to secure a lanyard 242 to a building. The advantages of the single lanyard discussed in connection with FIG. 9 are realized as yoke 226, and compression fitting 244 are identical to yoke 126 and fitting 144 respectively as shown in FIG. 9.

Lanyard 242 is threaded through two holes 284 and 286 in a plate 282 forming a loop 400 through which a cable 212 is threaded.

Holes 286 and 284 have diameters larger than that of lanyard 242 so that the distance between anchor 218 and a maximum distance 402 may be adjusted. Lanyard 242 is secured at one end by compression fitting 292 at one end and by compression fitting 244 at the other. Holes 284 and 282 have different axis, so that when tension is applied holes force lanyard 242 to bend at positions 404 and 406. The force of lanyard 242 on plate 282 locks plate 242 in position.

Figure 12:
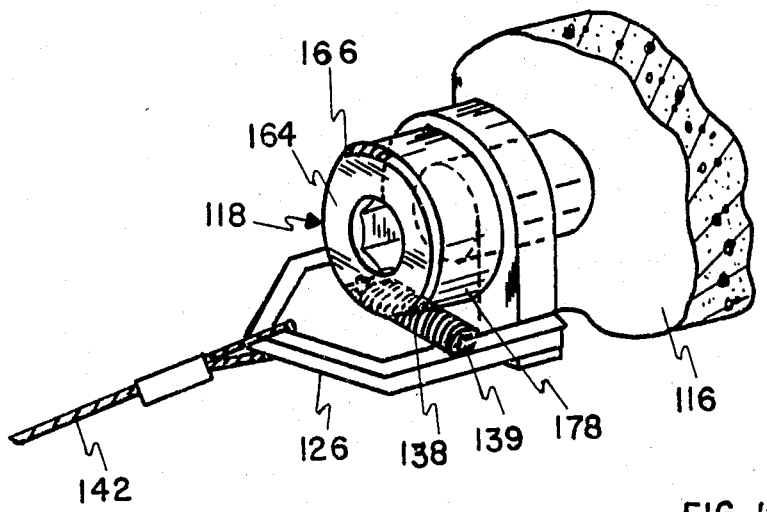
FIG. 12 is a prospective view of an alternate construction of the yoke and anchor portion of the inventive system during use.
Figure 13:
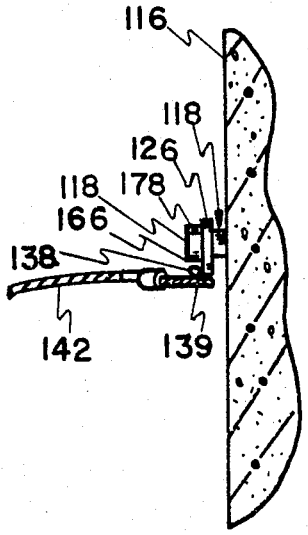
FIG. 13 is a side plan view illustrating the operation of yolk portion of FIG. 12.

The common yoke and spring portions of the embodiments shown in FIGS. 9 and 11 are most clearly seen in FIGS. 12 and 13. The above discussion is again incorporated by reference and the Figure are numbered in accordance with FIG. 9 for purposes of clarity.

As illustrated in FIG. 12, the anchor 118 used in accordance with the present invention comprises a flat portion 164 and a bevelled front edge 166.

When it is desired to attach the yoke to a building, the inside of yoke 126 is first placed over the head 178 of anchor 118. The yoke is then pushed downwardly, while at the same time being advanced toward the building. Once this action has sufficiently progressed the anchor will be brought into snapping engagement with the yoke by spring 138. Conversely, removal is achieved by advancing the spring over face 164 of anchor 118.

FIGS. 12 and 13 show that the inventive system must be dimensioned so that the axis 139 of spring 138 be inwardly disposed with respect to edge 16. Otherwise, spring 138 might not retain the yoke on anchor 118. Indeed, if axis 139 were outwardly disposed with respect to edge 166, there would be an insufficient surface to maintain the mechanical tension of the spring which engages the yoke and the system would become unreliable. Accordingly, the inventive system is designed so that axis 139 is always closer to wall 116 than is edge 166.

While illustrative embodiments of the present invention have been described, it is, of course, understood that various modifications will be obvious to those of ordinary shill in the art, and such modifications are within the spirit and scope of the invention which is limited and defined only by the appended claims.

What is claimed is:

1. A safety system, comprising:

(a) a plurality of anchors having support posts and heads and secured to and disposed vertically at spaced intervals along the outside surface of a building;

(b) yoke means a generally U shaped yoke configured and dimensioned to be fitted on and secured around one of said plurality of anchors, with a side of said yoke facing said building, having a pair of holes at its ends;

(c) spring means comprising a coil spring with each of the ends of said spring positioned adjacent one of the holes of said yoke for maintaining said yoke on its respective anchor;

(d) a scaffold; and (e) a lanyard having two ends, said lanyard being secured to said scaffold and comprising a pair of loops at its ends, each of said loops passing through one of said holes of said yoke, and said loops being secured to said spring adjacent the side of said yoke which is opposite the side of said yoke which is adjacent the building.

2. A safety system, comprising;

(a) a plurality of anchors having suppost posts and heads and secured and disposed vertically at spaced intervals along the outside surface of a building;

(b) yoke means having first and second generally U shaped elements opposingly engaged at their ends for pivotal positioning of said second U shaped element with reference to said first U shaped element, said first U shaped element being configured and dimensioned to be fitted on and secured around one of said plurality of anchors, said second U shaped element being configured and dimensioned to be pivotly moved around the head of said anchor;

(c) spring means comprising a coil spring with each of its ends secured to said second U shaped element for maintaining said yoke means on said anchors;

(d) a scaffold; and (e) lanyard means secured at one end to said scaffold and at the other end to said second U shaped element of said yoke means for securing said scaffold to the side of a building in order to prevent movement thereof.

3. A safety device as in claim 2 wherein said lanyard means enjoys a plate having a plurality of holes, said lanyard means passing through said holes in different directions.

4. A safety device as in claim 2 wherein said lanyard means further comprises adjustable buckling means for forming a loop, said loop connecting to said scaffold, and being adjustable in size by adjustment of said buckling means.

5. A safety device as in claim 4 wherein said lanyard means comprises a cable and said buckling means comprises a plate disposed on said cable and having a curved portion, and a cylinder disposed at the end of said cable, said cylinder being adapted to mate with said curved portion, said plate having holes for receiving said cable, said holes positioned, configured and dimensioned so as to urge said cylinder into said curved portion when tension is applied to said lanyard cable.

6. A safety device as in claim 2, wherein the surface of the head of said anchor has a sharp right angle edge adjacent said building and beveled outer edge opposite said building.

7. A safety device as in claim 2 wherein said spring attached to said second U shaped element has its axis disposed closer to said building than the outer edge of the head of said anchor when said yoke means is engaged to said anchor.

* * * * *